US005622316A

United States Patent [19]

Drechsel

[11] Patent Number: 5,622,316

[45] Date of Patent: Apr. 22, 1997

[54] SELF-ADJUSTING JET BREAKER FOR IMPACT SPRINKLERS

[76] Inventor: Arno Drechsel, Via Castel Mareccio 4, 39100 Bolzano, Italy

[21] Appl. No.: 511,322

[22] Filed: Aug. 4, 1995

Related U.S. Application Data

[63] Continuation of Ser. No. 167,986, filed as PCT/EP92/01142 May 21, 1992, abandoned.

[30] Foreign Application Priority Data

Jun. 27, 1991 [IT] Italy ..... VI91A0105

[51] Int. Cl.[6] ..... B05B 3/02

[52] U.S. Cl. ..... 239/230; 239/233; 239/222.15

[58] Field of Search ..... 239/222.15, 222.17, 239/222.21, 230, 232, 233

[56] References Cited

U.S. PATENT DOCUMENTS

| | | | |
|---|---|---|---|
| 1,710,107 | 4/1929 | Orr | 239/233 |
| 2,606,789 | 8/1952 | Royer | 239/230 |
| 3,580,507 | 5/1971 | Beamer | 239/233 |
| 3,592,388 | 7/1971 | Friedlander | 239/233 |
| 4,109,866 | 8/1978 | Brandl | 239/233 |
| 4,161,286 | 7/1979 | Beamer et al. | 239/230 |

FOREIGN PATENT DOCUMENTS

| | | |
|---|---|---|
| 1576657 | 8/1969 | France . |
| 975525 | 2/1954 | Germany . |
| 313915 | 7/1956 | Switzerland . |
| 330330 | 6/1930 | United Kingdom . |
| 2138704 | 10/1984 | United Kingdom . |

*Primary Examiner*—Andres Kashnikow
*Assistant Examiner*—Lisa Douglas
*Attorney, Agent, or Firm*—Wolf, Greeenfield & Sacks, P.C.

[57] ABSTRACT

A self adjusting jet breaker device for impact sprinklers having a spout connected to a pressurized water supply line using a rotary coupling, a terminal nozzle for generating a water jet, and an oscillating arm having a baffle. The device is arranged on the oscillating arm and includes an active surface adapted to interact with the water jet between two successive oscillations of the arm. The active surface of the device has an angle of inclination with respect to a longitudinal axis of the arm such as to be substantially tangent to the water jet as the first surface moves downward from above. The angle of inclination increases during the entire downward transit and decreases during an upward transit, so as to always receive an upward thrust from the water jet. The device optimally distributes and breaks up the jet, and increases the beat frequency of oscillations of the arm in an automatic manner, i.e. adapting to both high and low jet supply pressures.

18 Claims, 2 Drawing Sheets

SELF-ADJUSTING JET BREAKER FOR IMPACT SPRINKLERS

This application is a continuation of application Ser. No. 08/167,986, filed as PCT/EP92/01140 May 21, 1992, now abandoned.

The present invention relates to a self-adjusting jet breaker device, particularly for impact sprinklers.

The breaker device according to the invention can be mounted on impact sprinklers of the type described. Such sprinklers generally comprise spout which is connected to a supply line by means of a braked rotary coupling, with a terminal nozzle for generating a jet and an oscillating arm provided with a baffle which periodically interferes with the jet.

In said sprinklers, the baffle, during its interference with the jet, captures part of the kinetic energy of said jet, imparting to the arm an instantaneous rotary torque which tends to cause both the oscillation of the arm and the rotation of the spout in steps of preset breadth. The baffle furthermore has the function of periodically breaking the fluid column so as to distribute the water proximate to the sprinkler as well.

However, when the pressure of the jet is low, its breakup is limited due to the slow rate at which said jet interacts ith the baffle. If one wishes to increase the oscillation frequency of the arm even with low jet supply pressures, this cannot be achieved by means of conventional fixed-geometry baffles but by modifying, ithin certain limits, the balance of the arm or possibly the rigidity of resilient members.

DE-C-975525 discloses an impact sprinkler having an adjustable baffler connected to the rotation apparatus of the sprinkler. This sprinkler allows for a greater range of adjustment at the cost, however, of a greater complexity in construction and operation.

The aim of the present invention is to provide a jet breaker device which allows to significantly increase the beat frequency for an equal jet pressure.

An object of the present invention is to provide a self-adjusting jet breaker device which is able to improve the breakup of the jet especially at low pressures, leaving its maximum range substantially unchanged.

Another object of the present invention is to provide a jet breaker device which can interact with the jet in one or both of the rotation directions of the sprinkler.

Another object of the present invention is to provide a jet breaker device which has an extremely simple and economical structure.

This aim, these objects, and others which will become apparent hereinafter, are achieved by a jet breaker device of the above described type, having the characteristics of the independent claim 1.

A jet breaker device of this type can be applied to existing impact sprinklers so as to significantly increase the beat frequency and intensify the breakup of the jet in one or both of the directions in which the sprinkler rotates about its own vertical axis.

Further characteristics and advantages will become apparent from the detailed description of some preferred but not exclusive embodiments of the self-adjusting jet breaker device according to the invention, illustrated only by way of non-limitative example in the accompanying drawings, wherein.

Figure 1:
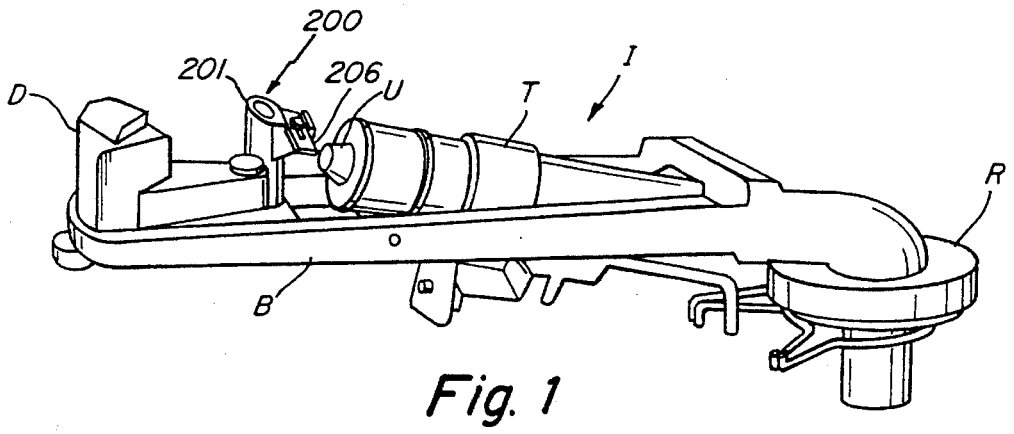
FIG. 1 is a general perspective view of a jet breaker device according to the invention, installed on a per se known impact sprinkler.
Figure 2:
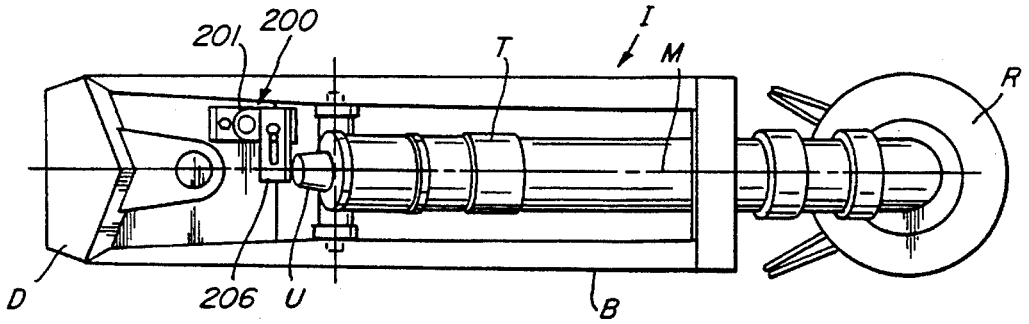
FIG. 2 is a top view of the arrangement of FIG. 1.

A jet breaker device according to the invention, generally designated by the reference numeral 200, is mounted on an impact sprinkler designated by the letter I. The sprinkler comprises a spout T which has a braked coupling R at one end. Coupling R can rotate about a vertical axis, and is adapted to connect the spout to a pressurized water supply line. Coupling R is also rigidly associated with a frame, which not shown in the drawings.

A nozzle U for generating a jet G is arranged at the free end of the spout T, while an oscillating arm B is pivoted proximate to its central portion. A baffle D is arranged dt the outer end of the arm and is used to periodically and impulsively capture part of the energy of the jet in order to make the arm oscillate about its fulcrum and thereby rotate the spout about its own vertical axis. It is evident that the device according to the invention can be equally installed on sprinklers of a different type, provided that they have the same general characteristics.

The jet breaker device 200 comprises one or more active surfaces which can be anchored to the arm B, for example, in an intermediate position between its oscillation axis and the baffle, so as to interact at least once with the jet between two successive oscillations of the arm. Alternatively, the device 200 might also be mounted at a greater distance from the baffle, achieving the same final result.

Figure 3:
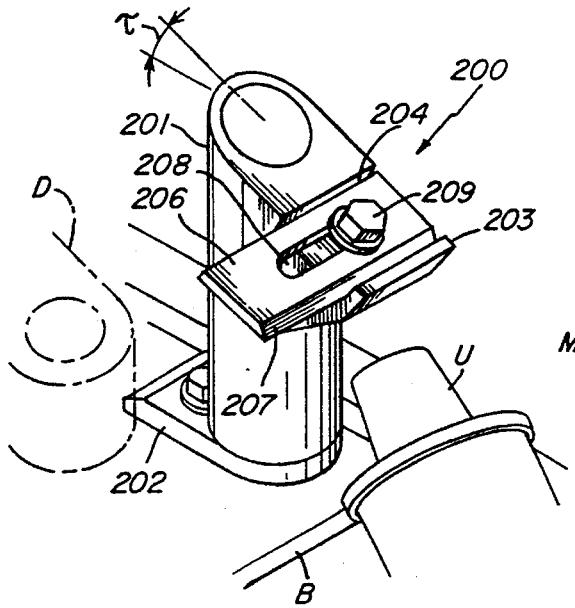
FIG. 3 is an enlarged perspective view of the jet breaker device of FIGS. 1 and 2.

In the first embodiment, shown in detail in FIG. 3, the device 200 comprises a pedestal 201 which is anchored to the arm B, by means of a fixing plate 202, on one side with respect to its centerline M. A bracket support 203 is fixed at the top of the pedestal 201 and is provided with a grooved guide 204. Guide 204 slidingly accommodates a blade 206 provided with a sharp edge 207 and with an elongated fixing hole 208. The active surface of the device, which is intended to interfere with the jet, is constituted by the lower face of the blade 206. Blade 206 is fixed in position along the guide 204 of the support 203 by means of a bolt 209 which passes through the elongated hole 208. It is thus possible to arrange the device 200 on one side or on both sides with respect to the longitudinal axis of the arm B, so that the blade interferes with the jet during the rotation of the sprinkler in one direction or in both directions.

Figure 4:
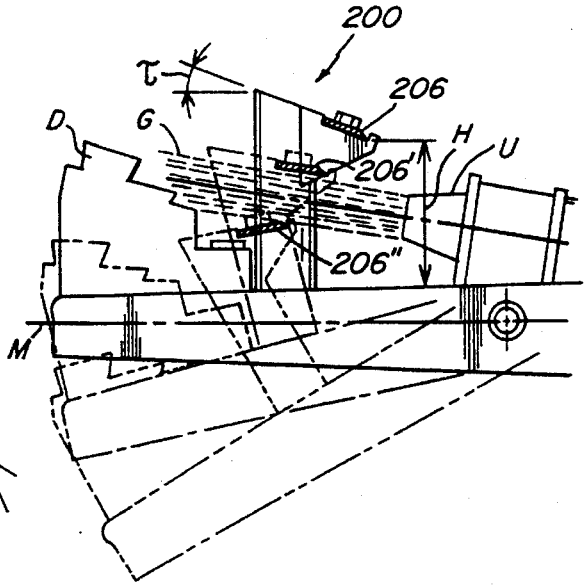
FIG. 4 is a diagram of the operation of the device of FIG. 3.

As can be seen in FIG. 4, the bracket support 203 is inclined with respect to the axis of the pedestal 201, so that the blade 206 forms an angle $\tau$ with the longitudinal axis M of the arm B. The height of the pedestal 201 and the shape of the bracket support 203 are also such that the blade is at a minimum distance H from the longitudinal axis of the arm.

Thus, after the arm has started its downward oscillation starting from its upper stroke limit, the jet G initially interacts with the baffle D, causing the arm B to rotate downward without encountering the jet breaker device. At a certain point, the blade 206 of the jet breaker 200 will begin to skim the jet G, being approximately parallel to the axis thereof, as indicated by the position 206' shown in broken lines in FIG. 4. In this position, a substantially nil perpendicular force acts on the blade, while the positive sharpening angle of the leading edge of the blade facilitates its penetration in the jet.

As the arm moves downward, the negative incidence of the blade 206 with respect to the jet gradually increases. Thus, in this step part of the jet is progressively deflected downward, giving said jet a peculiar fan shape. The reaction F which acts at right angles and upward on the blade also increases correspondingly, generating a braking torque on the arm, i.e. a torque which tends to dampen the downward oscillation and to cause the early reversal of the direction of rotation of the arm, which coincides with its lower stroke limit. The braking torque will be maximum in the lower position, designated by 206" in FIG. 4, which coincides with the position in which the blade enters the jet during the upward movement of the arm. Thus, in its upward movement, the blade 206 interacts with the jet G, exerting an accelerating torque on the arm, i.e. a torque which tends to facilitate its upward movement. This acceleration in ascent, combined with braking during descent, determines an overall increase in the beat frequency of the arm, and thus in the rotation rate of the sprinkler. Naturally, once the jet has abandoned the region of interference with the breaker and with the baffle, it can resume its shape, achieving its maximum range. At high pressure, the blade transit speed is such as to cause a sudden and effective breakup of the jet both during its downward movement and during its upward movement. As shown in FIG. 4, the top of blade 206 is positioned at a greater distance from the arm than the baffle D such that the water jet, during oscillation of the arm, interacts with the blade 206 after the water jet no longer interacts with the baffle D.

Experimental tests have shown that blade inclination angles $\tau$ between 15° and 30°, and preferably equal to approximately 25°, give the best results in varying the frequency and breakup of the jet. The distance H can vary according to the size of the baffle D and according to the distance from the arm oscillation axis.

Figure 5:
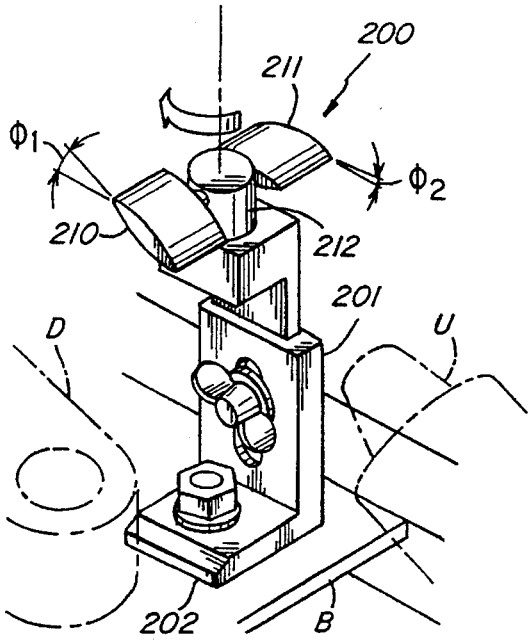
FIG. 5 is a perspective view of a second embodiment of the device according to the invention.
Figure 6:
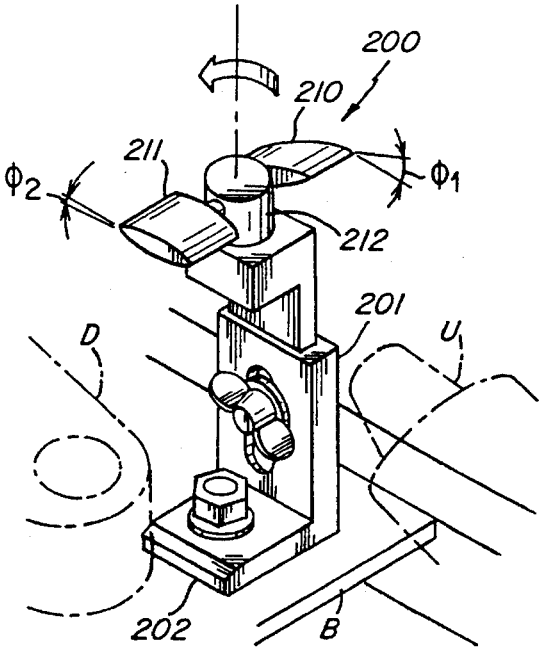
FIG. 6 is a view of the device of FIG. 5 in a different operating condition.

The second embodiment of the jet breaker, shown in FIGS. 5 and 6, wherein the corresponding elements have been designated by the same reference numerals, differs from the first one in that it has a pair of active surfaces having different inclinations, instead of a single surface. In particular, the active surfaces are constituted by the lower faces of two deflector wings 210, 211 which extend radially and on opposite sides of a ratchet 212. Ratchet 212 is mounted on the adjustable-length pedestal 201 so as to be able to rotate vertically. The wings 210 and 211 have a convex shape, similar to a wing contour, with a median axis which forms respective angles $\Phi_1$ and $\Phi_2$ with respect to the longitudinal axis of the arm.

By means of a snap-locking device, the ratchet 212 can be rotated manually and retained in two diametrically opposite fixed positions, so as to expose only one of the wings 210 and 211 to the jet, as clearly shown in FIGS. 5 and 6.

Figure 7:
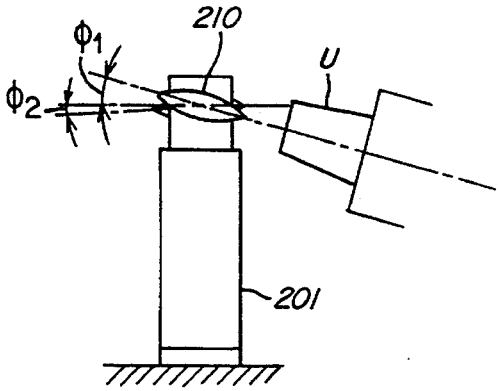
FIGS. 7 and 8 are schematic views of the operation of the device shown in FIGS. 5 and 6.
Figure 8:
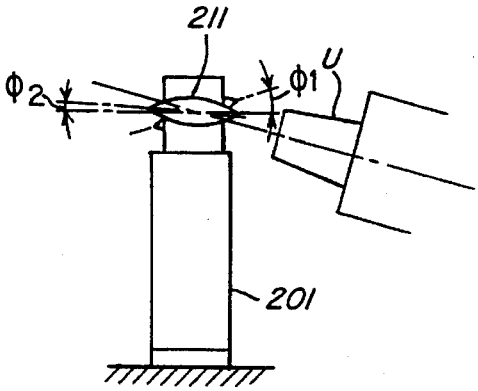

FIGS. 7 and 8 schematically illustrate the fact that operatively the angle $\Phi_1$ is such that the median axis of the wing 210 is approximately parallel to the direction of the jet during transit through said jet. Therefore, the wing 210 is used mainly to break up the jet without transmitting appreciable forces to the arm during its oscillation. On the contrary, the angle $\Phi_2$ of the wing 211 is such that the jet is always inclined with respect to the wing 211 during its interference. This will cause, on the lower surface of the wing 211, a thrust with a perpendicular component directed upward, which applies a clockwise torque to the arm, with an effect similar to the one described for the model of FIG. 3.

The above description and experimental tests show that the jet breaker device according to the invention achieves the intended aim and objects and in particular it is noted that it produces an optimum distribution and breakup of the jet together with an increase in the beat frequency in an automatic manner, i.e. adapting to both high and low jet supply pressures. The device according to the invention is also simple and economical to manufacture and easy to install on existing sprinklers with no modification of their structure.

The device thus conceived is susceptible to numerous modifications and variations, all of which are within the scope of the inventive concept expressed in the accompanying claims. All the details may furthermore be replaced with technically equivalent elements.

Where technical features mentioned in any claim are followed by reference signs, those reference signs have been included for the sole purpose of increasing the intelligibility of the claims and accordingly, such reference signs do not have any limiting effect on the scope of each element identified by way of example by such reference signs.

I claim:

1. An impact sprinkler with a removable self-adjusting jet breaker device, the impact sprinkler comprising:

a water spout having a fixed end that connects to a pressurized water pipe by means of a rotatable joint with a first rotation axis and having a second end;

a nozzle arranged at the second end of said spout for generating a water jet;

a swingable arm with a longitudinal axis mounted for oscillation about a second axis substantially perpendicular to said first rotation axis;

a water deflector, mounted to said swingable arm at a first transverse distance from said second axis, that cyclically interacts with the water jet, said water deflector deflecting the water jet to thereby cause oscillation of said arm from a starting position and breaking up the water jet to cause said swingable arm to move back toward the starting position, wherein said water deflector extends to a maximum height, measured from the longitudinal axis, equal to a first value;

a jet breaker device removably mounted to said swingable arm at a second transverse distance from said second axis, wherein said second distance is less than said first distance;

wherein said jet breaker device has at least one first active surface longitudinally spaced from said water deflector to interact with said water jet between successive oscillations of said swingable arm;

wherein said first active surface forms an inclination angle with respect to said longitudinal axis such that said first active surface is substantially tangent to the water jet when said first active surface starts to interact with the water jet;

wherein said first active surface extends to a maximum height measured from said longitudinal axis, equal to a second value that is greater than said first value so that said first active surface interacts with the water jet after the water jet no longer interacts with said water deflector during oscillation of the swingable arm.

2. The sprinkler of claim 1, wherein said first active surface is progressively inclined with respect to a longitudinal axis of the water jet during transit through said water jet, so as to receive an upward thrust.

3. The sprinkler of claim 1, wherein said first active surface is constituted by a lower face of a substantially planar blade which is fixed to a top of a pedestal which is anchored to said swingable arm.

4. The sprinkler of claim 3, wherein said planar blade can move along a guiding groove defined in a bracket support, said planar blade having an elongated central hole for anchoring in said guiding groove of said bracket support in lateral terminal positions.

5. The sprinkler of claim 3, further comprising a second active surface mounted at the top of said pedestal in a position which is diametrically opposite and with a different inclination angle with respect to the first active surface.

6. The sprinkler of claim 5, wherein said first active surface and said second active surface extend radially from a ratchet which is constructed and arranged to rotate at the top of said pedestal and can be arranged in at least two diametrically opposite fixed angular positions.

7. The sprinkler of claim 1, wherein the inclination angle of said first active surface with respect to the longitudinal axis of said swingable arm is between 15° and 30°.

8. The sprinkler of claim 7, wherein said inclination angle is approximately 25°.

9. The sprinkler of claim 1, wherein said first active surface is constructed and arranged such that as it interacts with the water jet as the swingable arm rotates, the water jet is progressively deflected downward in a fan shape.

10. The sprinkler of claim 1, wherein said first active surface is constructed and arranged such that a torque is imposed on the swingable arm as the water jet interacts with the first active surface, the torque resisting rotation of the swingable arm about the second axis in a first direction of rotation of the swingable arm and promoting rotation of the swingable arm about the second axis in a second direction of rotation of the swingable arm.

11. An impact sprinkler with a removable self-adjusting jet breaker device, the impact sprinkler comprising:

a water spout having a first end that connects to a pressurized water pipe by means of a rotatable joint with a first rotation axis and having a second end;

a nozzle arranged at the second end of said spout for generating a water jet;

a swingable arm with a longitudinal axis mounted for oscillation about an oscillation axis substantially perpendicular to said first rotation axis;

a water deflector mounted to said swingable arm at a first transverse distance from said oscillation axis that cyclically interacts with the water jet, said water deflector deflecting the water jet to thereby cause oscillation of said swingable arm from a starting position and breaking up the water jet to cause said swingable arm to move back toward the starting position;

a jet breaker device removably mounted to said swingable arm at a second transverse distance from said oscillation axis;

wherein said jet breaker device has at least one first active surface longitudinally spaced from said water deflector to interact with said water jet between successive oscillations of said arm;

said first active surface forming an inclination angle with respect to said longitudinal axis such that said first active surface is substantially tangent to the water jet when said first active surface starts to interact with the water jet;

said jet breaker device further having a second active surface which is diametrically opposite and has a different inclination angle with respect to said first active surface;

wherein said first and said second active surfaces extend radially from a ratchet, said ratchet being mounted to said arm for rotation about a third axis for selective orientation in either of at least two diametrically opposite fixed angular positions.

12. The sprinkler of claim 11, wherein said first active surface is progressively inclined with respect to a longitudinal axis of the water jet during transit through said water jet, so as to receive an upward thrust.

13. The sprinkler of claim 11, wherein said first active surface is constituted by a lower face of a substantially planar blade which is fixed to a top of a pedestal which is anchored to said swingable arm.

14. The sprinkler of claim 11, wherein the inclination angle of said first active surface with respect to the longitudinal axis of said swingable arm is between 15° and 30°.

15. The sprinkler of claim 14, wherein said inclination angle is approximately 25°.

16. The sprinkler of claim 11, wherein said first active surface is constructed and arranged such that a torque is imposed on the swingable arm as the water jet interacts with the first active surface, the torque resisting rotation of the swingable arm about the second axis in a first direction of rotation of the swingable arm and promoting rotation of the swingable arm about the second axis in a second direction of rotation of the swingable arm.

17. The sprinkler of claim 11, wherein said first active surface is constructed and arranged such that as it interacts with the water jet as the swingable arm rotates, the water jet is progressively deflected downward in a fan shape.

18. An impact sprinkler with a removable self-adjusting jet breaker device, the impact sprinkler comprising:

a water spout having a first end that connects to a pressurized water pipe by means of a rotatable joint with a first rotation axis and having a second end;

a nozzle arranged at the second end of said spout for generating a water jet;

a swingable arm with a longitudinal axis mounted for oscillation about a second axis substantially perpendicular to said first rotation axis;

a water deflector mounted to said swingable arm at a first transverse distance from said second axis that cyclically interacts with the water jet, said water deflector deflecting the water jet to thereby cause oscillation of said swingable arm from a starting position and breaking up the water jet to cause said swingable arm to move back toward the starting position, wherein said water deflector extends to a maximum height measured from the longitudinal axis, equal to a first value;

a jet breaker device removably mounted to said swingable arm at a second transverse distance from said second axis, wherein said second distance is less than said first distance;

wherein said jet breaker device has at least one first active surface longitudinally spaced from said water deflector to interact with said water jet between successive oscillations of said arm;

said first active surface forming an inclination angle with respect to said longitudinal axis such that said first active surface is substantially tangent to the water jet when said first active surface starts to interact with the water jet;

wherein said first active surface extends to a maximum height, measured from above said longitudinal axis, equal to a second value that is greater than said first value so that said first active surface interacts with the water jet, after the water jet no longer interacts with said water deflector during oscillation of the swingable arm; and wherein said jet breaker device further comprises a second active surface which is diametrically opposite and has a different inclination angle with respect to said first active surface;

said first and said second active surfaces extending radially from a ratchet;

said ratchet being mounted to said swingable arm for rotation about a third axis substantially transverse to said longitudinal axis for selective orientation in either of at least two diametrically opposite fixed angular positions.

* * * * *